US005570618A

United States Patent [19]

Habermehl et al.

[11] Patent Number: 5,570,618

[45] Date of Patent: Nov. 5, 1996

[54] FINGER RELEASE MECHANISM FOR COLLATED STRIP SCREWDRIVER

[76] Inventors: G. Lyle Habermehl, 7528 Hickory Hill Ct., Whites Creek, Tenn. 37189; Paul T. Scherer, 4145 Bridgemont La., Lexington, Ky. 40514

[21] Appl. No.: 331,729

[22] Filed: Oct. 31, 1994

[51] Int. Cl.[6] ..... B25B 23/04

[52] U.S. Cl. ..... 81/434; 81/435

[58] Field of Search ..... 81/434, 435, 57.37, 81/433; 227/136, 135, 120

[56] References Cited

U.S. PATENT DOCUMENTS

| | | | |
|---|---|---|---|
| 3,826,419 | 7/1974 | Maestri | 227/136 |
| 4,146,071 | 3/1979 | Mueller et al. . | |
| 4,167,229 | 9/1979 | Keusch et al. . | |
| 4,581,964 | 4/1986 | Takatsuru | 81/434 |
| 5,186,085 | 2/1993 | Monacelli . | |

*Primary Examiner*—Bruce M. Kisliuk
*Assistant Examiner*—Joni B. Danganan
*Attorney, Agent, or Firm*—Dorsey & Whitney LLP

[57] ABSTRACT

This invention relates to an advance and release mechanism for strips of a screwdriver assembly that sequentially drives fasteners retained in a holding strip securing a plurality of fasteners in a row. The apparatus has a slide body with a lateral slot and an intersecting vertical bore. The lateral slot has a uniform transverse cross-section configured to slidingly receive the strip. A driver shaft including fastener driving bit means for engaging and driving a lead fastener in succession into said work piece is journalled and longitudinally slidably housed in the bore between an engaged position and a withdrawn position. Advance means are mounted to the body for incrementally forwardly advancing the fasteners of the strip within the lateral slot in succession and for aligning the lead fastener coaxially with the bore. The advance means includes: a shuttle housed in the body and reciprocally movable between an advanced position and retracted position; a pawl pivotably supported on the shuttle, the pawl having a strip pusher arm at a forward end thereof; pawl biasing means engaging the pawl and shuttle for urging the pusher arm into parallel engagement with the strip; and pawl release means engaging the pawl for manually disengaging the pawl from the strip, thereby permitting the screw strip to be removed from the lateral slot.

16 Claims, 5 Drawing Sheets

FINGER RELEASE MECHANISM FOR COLLATED STRIP SCREWDRIVER

FIELD OF THE INVENTION

The invention relates to a strip advance and release mechanism for an apparatus which sequentially drives fasteners retained in a holding strip.

BACKGROUND OF THE INVENTION

Conventional screw drive assemblies are known for driving collated screws in which screws are connected to each other by a retaining strip of plastic material. Screws carried by such strips are adapted to be successively advanced to a position in alignment with the bit of a reciprocating power screwdriver.

The invention represents a modification of prior art devices to provide a strip advance and release mechanism.

The prior art suffers from the disadvantage that a cover plate must be removed in order to access the screw strip when jamming occurs or if the strip is to be removed. Removal and replacing the cover plate involves significant time and working conditions may be such that handling small parts is difficult. Misplacing or loosing the plate or retaining screws renders the entire assembly inoperative and replacements may not be readily available. Therefore the invention addresses this disadvantage by providing a quick release mechanism to enable the strip to be easily withdrawn without requiring the cover plate to be removed.

When the lead screw of a strip is located and aligned, the power screwdriver bit may be used to screw the fastener into a work piece. In the course of the bit engaging the screw and driving it into the work piece, the lead screw becomes detached from the frangible plastic strip leaving the remainder of the strip as a continuous undisturbed length.

Such conventional strips are described for example in U.S. Pat. No. 4,167,229 issued Sep. 11, 1979 the disclosure of which is specifically incorporated herein by reference.

When such strips are used in a power screwdriver, the strip serves to continuously feed successive screws into a position where they may be automatically engaged by the screwdriver bit when properly aligned. The strip further serves in assisting to drive the screw into a work piece. In the strip, each screw has a threaded shaft which is threadably engaged in a sleeve of the plastic strip. Therefore when the screwdriver engages and rotates each screw, the screw turns within the sleeve thereby acting to guide the screw as it moves downwardly into threaded engagement with the work piece.

Preferably once the tip of the screw becomes engaged in the work piece, the head of the screw comes into contact with the sleeve and further downward movement of the screw into the work piece draws the head downwardly and ruptures the sleeve. The sleeve generally has a relatively solid back strap with frangible holding straps wrapping around the screw which break when the screw head passes through the sleeve. The remainder of the strip remains substantially intact as a continuous length after the lead screw has broken away from its frangible straps. Since the remainder of the strip is continuous and undisturbed, advancing the strip with each successive screw to be driven follows a repetitive cycle.

Conventional power screwdrivers for driving such collated strips are described in U.S. Pat. No. 4,146,071 to Mueller issued Mar. 27, 1976, and U.S. Pat. No. 5,186,085 to Monacelli issued Feb. 16, 1993. The disclosures of the above patents are specifically incorporated herein by reference.

Conventional power screwdrivers include a screwdriver shaft which is rotatably and reciprocally housed in the apparatus. The shaft is connected to a conventional pistol grip screwdriver and driven by the electric motor of the screwdriver. The downward portion of the shaft includes a screw driving bit which may be interchangeable, for engaging the head of each successive screw as the screw is moved into a locating driving position axially aligned under the screwdriver shaft.

The screw strip is fed through a lateral slot in the slide body. The advancing mechanism and screws may jam up within the lateral slot if there is any malfunction or foreign matter enters the lateral slot. Conventional screw driving assemblies have a lateral slot which is formed between a rear wall of the slide body and a forward removable cover plate. In order to remedy the jam situation or to remove an unused portion of a strip, it is necessary for the operator to remove a holding screw and the cover plate. On construction sites or in manufacturing environments it may be very inconvenient to handle small pieces such as the retaining screw and cover plate. If the operator accidentally drops these parts they may be irretrievably lost and cause considerable inconvenience since replacement parts are not readily available.

Therefore it is desirable to produce a screw driving assembly which includes means by which the screw strip can be removed from the lateral slot preferably without requiring disassembly of the screw driving apparatus.

Another disadvantage of prior art strip advance mechanisms, is that drive pawls which engage and advance the strip move along a path which is not parallel to the direction in which the strip is to be advanced. Such drive pawls cause some binding of the screws and screw strip which are being advanced and therefore require greater forces to be applied to the strip to advance it.

SUMMARY OF THE INVENTION

The invention overcomes the disadvantages of the prior art in a novel manner by providing an advance and release mechanism for strips of a screwdriver assembly that sequentially drives fasteners retained in a holding strip securing a plurality of fasteners in a row. The apparatus has a slide body with a lateral slot and an intersecting vertical bore. The lateral slot has a uniform transverse cross-section configured to slidingly receive the strip. A driver shaft includes fastener driving bit means for engaging and driving a lead fastener in succession into said work piece. The shaft is journalled and longitudinally slidably housed in the bore between an engaged position and a withdrawn position. Advance means are mounted to the body for incrementally forwardly advancing the fasteners of the strip within the lateral slot in succession and for aligning the lead fastener coaxially with the bore. The advance means include: a shuttle housed in the body and reciprocally movable between an advanced position and retracted position; a pawl pivotably supported on the shuttle, the pawl having a strip pusher arm at a forward end thereof; pawl biasing means engaging the pawl and shuttle for urging the pusher arm into engagement with the strip; and pawl release means engaging the pawl for manually disengaging the pawl from the strip, thereby permitting the screw strip to be removed from the lateral slot.

Therefore, in accordance with the invention, a spring loaded pawl is used to advance successive fasteners to be screwed into a work piece. The pawl is resiliently biased such that it may be withdrawn relative to the screw strip and trails over the screws to engage a successive fastener.

Preferably the pawl comprises a rocker which is pivoted about its middle on the shuttle. The pawl includes a manual release arm at a rearward end which extends through an opening in the slide body. An operator therefore may easily withdraw the screw strip by depressing the manual release arm.

Therefore by use of the invention it is not necessary to disassemble the cover plate but merely to depress a manual release arm on the advancing pawl in order to draw the screw strip rearwardly.

The invention also permits a construction for power screwdrivers in which it is not necessary that the equivalent of the cover plate be removable.

In one aspect the invention provides an apparatus for sequentially driving fasteners retained in a holding strip securing a plurality of fasteners in a row, the apparatus comprising:

slide body means having lateral slot means and intersecting bore means intersecting the lateral slot means, the lateral slot means configured to slidingly receive said strip;

elongate driver shaft means having a shaft axis of rotation, said shaft including fastener driving bit means for engaging and driving fasteners in succession into said work piece, said shaft means being journalled and longitudinally slidably housed in said bore means for reciprocal movement relative the slide body between an engaged position and a withdrawn position;

advance means mounted to said slide body means for incrementally forwardly advancing the strip with its fasteners within the lateral slot means in succession into said bore means, said advance means comprising:

shuttle means housed in said slide body means and reciprocally movable between an advanced position and a retracted position, and pawl means carried by said shuttle means; the pawl means movable between a first position in which the pawl means is positioned to engage the strip to forwardly advance the strip within the lateral slot means on movement of the shuttle means from the retracted portion to the advanced position and to prevent rearward removal of the strip from the slide body means and a second position in which the pawl is disengaged from the strip and the strip may be removed rearwardly from the slide body means; and manual activation means manually activatable to move the pawl means from the first position to the second position.

Further aspects of the invention will become apparent upon review of the following detailed description.

BRIEF DESCRIPTION OF THE DRAWINGS

In order that the invention may be readily understood, a preferred embodiment of the invention will be described by way of example with reference to the accompanying drawings in which:

FIGS. 6, 7, 8 and 9 are sectional views similar to that of FIGS. 4 and 5 but showing merely the relative positions of the shuttle, pawl and screw strip and wherein:

FIGS. 6 and 7 show the advancing of the screw strip to the left toward the advanced position; and FIGS. 8 and 9 show the retraction of the shuttle and pawl to the right to engage a successive pawl.

DETAILED DESCRIPTION OF PREFERRED EMBODIMENTS OF THE INVENTION

The preferred embodiment of the invention as shown in the attached drawings represents a modification of existing electrically powered screwdriver assemblies. Although the invention may be embodied in a screwdriver apparatus which is completely redesigned, the invention may advantageously be incorporated in a modified conventional screwdriver to reduce retooling costs and to provide a means to retrofit existing assemblies.

Figure 1:
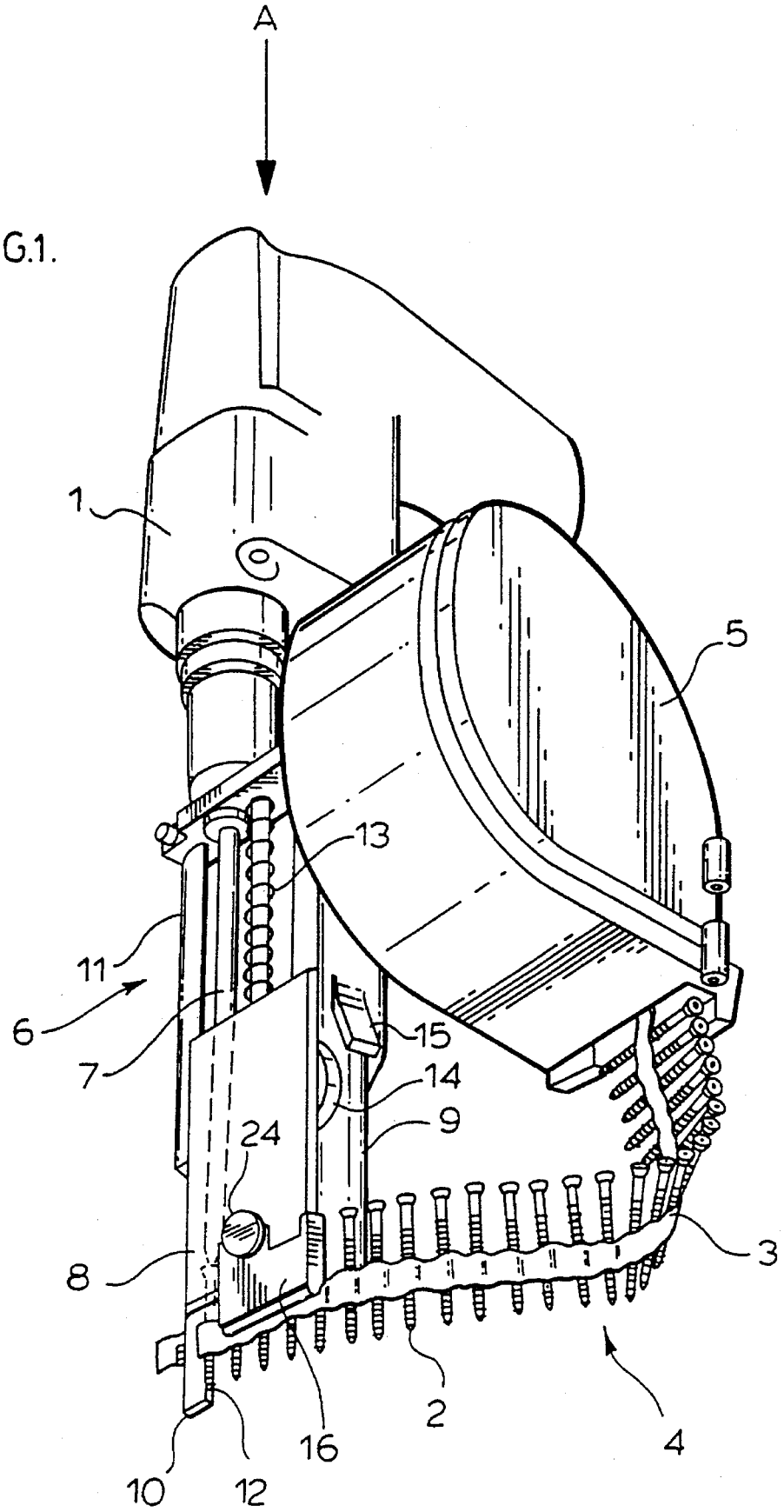
FIG. 1 is a perspective view of a screwdriving assembly including pistol grip screwdriver, coiled screw strip in a cartridge, and advancing mechanism.

Accordingly FIG. 1 illustrates an electrically powered screwdriver substantially of the type disclosed in U.S. Pat. No. 4,146,071. The pistol grip screwdriver 1 is used for driving screws 2 collated together in a parallel manner retained in a plastic strap 3 to form a coiled strip 4 which is housed within a cartridge 5. Strips 4 of such type are described in U.S. Pat. No. 4,167,229.

A screw driving assembly 6 is attached to the lower end of the screwdriver 1 and serves to feed the strip 4 in an incremental manner such that the screws 2 may be successively driven into a work piece.

The screwdriver 1 has an elongate shaft 7 with a screw driving bit 8 for engaging and driving successive screws 2 as they are axially aligned by the screw driving assembly 6. The assembly 6 includes a slide body 9 with a foot 10 which is abutted against the work piece 32, shown in FIG. 2, when screws 2 are to be driven.

A housing 11 is secured to the screwdriver 1 and a slide body 9 is slidably coupled to the housing 11 for displacement parallel to the axis of the shaft 7.

Figure 2:
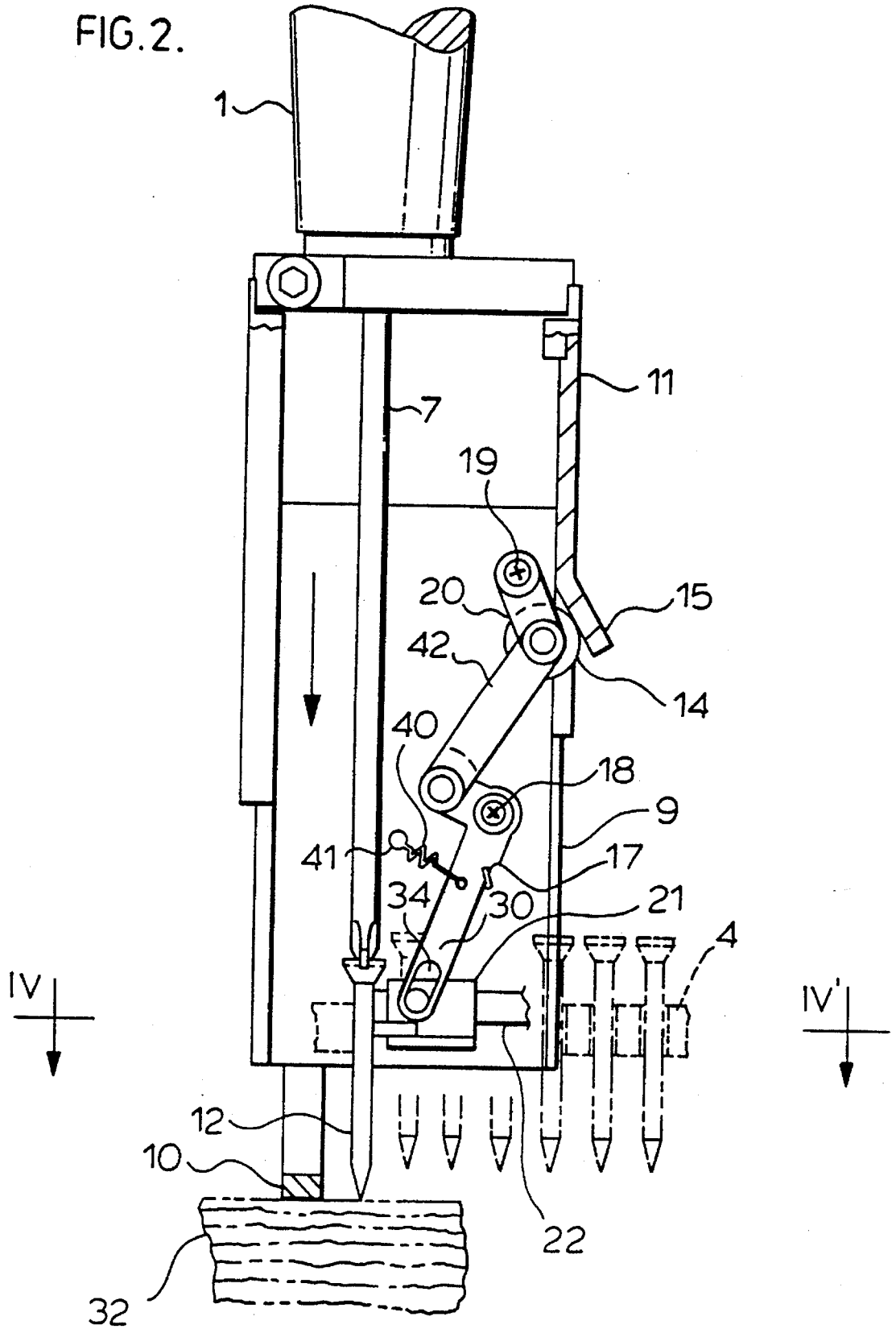
FIG. 2 is a cutaway front elevation view showing the advancing mechanism which advances successive screws into alignment for driving into a work piece.

In order to drive a screw 2, the operator engages the foot 10 with the work piece 32, as shown in FIG. 2. By gripping the handle of the screwdriver 1, the operator exerts downward pressure in the direction of arrow A and depresses the trigger of the screwdriver 1 to rotate the shaft 7 and to drive the shaft 7 downwardly into engagement with the lead screw 12. A spring 13 biases the housing 11 upwardly relative to the slide body 9 and therefore pressure exerted by the operator in direction of arrow A is resisted by the biasing force of the spring 13.

The screws 2 of the strip 4 are successively advanced by an indexing mechanism in response to the relative displacement between the housing 11 and slide body 9. As shown in FIGS. 1 and 2, the screw indexing mechanism includes a cam following wheel 14 which is housed within the slide body 9 and an inclined cam surface 15 formed in an overlapping portion of the housing 11. Relative movement between the housing 11 sliding in the slide body 9 produces movement between the wheel 14 and cam surface 15 resulting in actuation of the screw indexing mechanism.

A linkage mechanism which operates the indexing mechanism is shown in FIG. 2. As the housing 11 slides downwardly on the slide body 9, the cam wheel 14 engages and rides on cam surface 15.

With reference to the indexing linkage of FIG. 2, an indexing arm 17 is pivotably connected to the slide body 9 by a fixed pin 18. The indexing arm 17 is biased with a spring 40 to pivot clockwise to take the position shown in FIG. 2. Spring 40 extends between a post 41 on slide body 9 and indexing arm 17. A second fixed pin 19 is also attached to the body 9 to secure the link members 20 and 42 and wheel 14 together in an actuating linkage.

Figure 3:
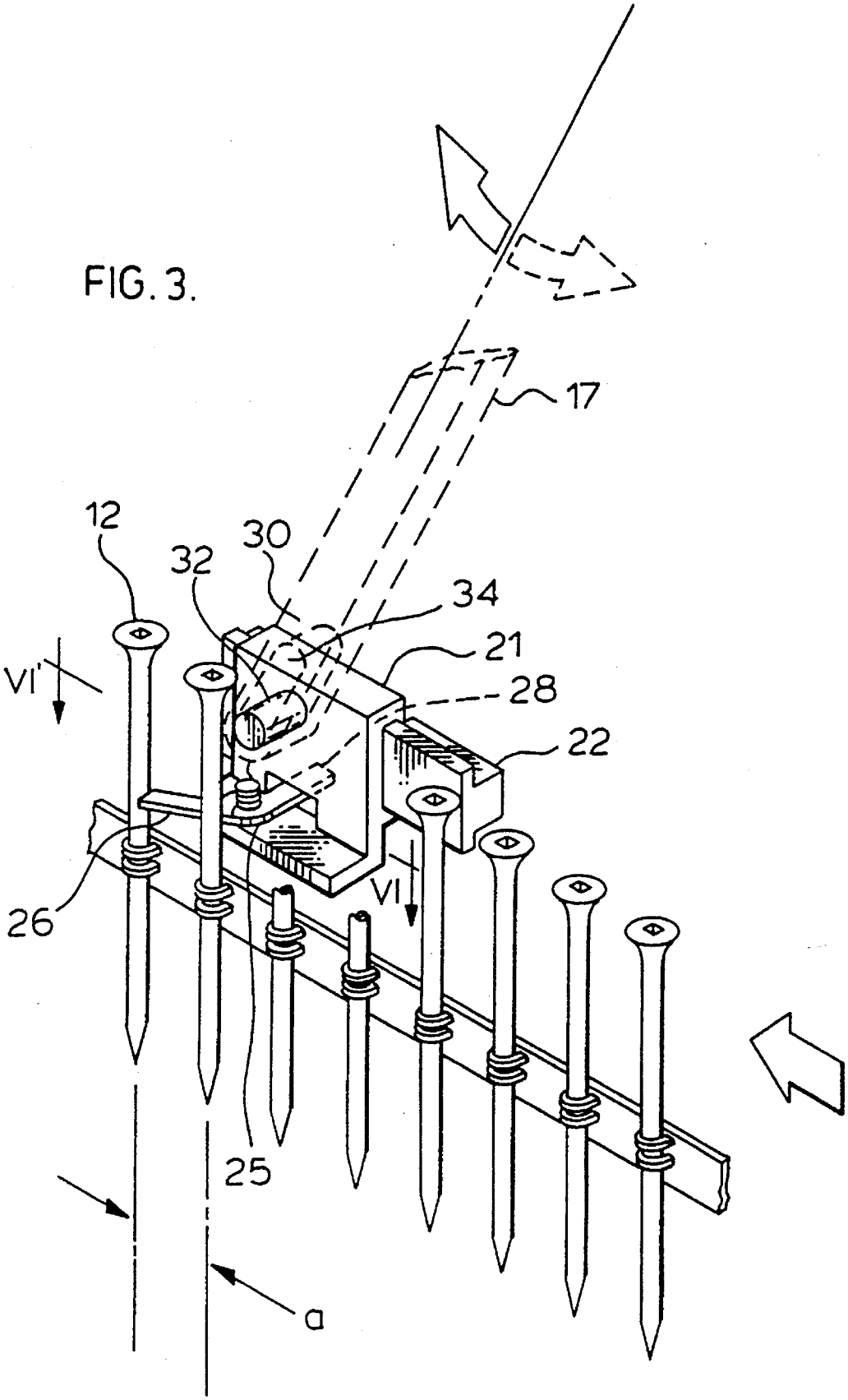
FIG. 3 is a perspective view showing the details of the sliding shuttle and spring loaded pawl of the advancing mechanism.

The actuating linkage therefore in response to relative sliding motion between the slide body 9 and the housing 11, reciprocally pivots the indexing arm 17 about the fixed pin 18, which moves the forward end 30 of the indexing arm to the right or the left as seen in FIGS. 2 and 3. The forward end 30 of the indexing arm 17 is coupled to a shuttle 21 with a fixed pin 32 on the shuttle received in a slot 34 in the arm 17. The shuttle 21 is mounted for sliding longitudinally along a beam 22 secured to the slide body 9 parallel to the screw strip and within a lateral slot 23 within slide body 9. Reciprocal pivoting of the indexing arm 17 slides the shuttle 21 back and forth along the beam 22 as best seen in FIG. 3. As illustrated, the lateral slot 23 extends substantially normal to the axis about which the shaft 7 rotates and the shuttle 21 slides substantially parallel in lateral slot 23.

Figure 4:
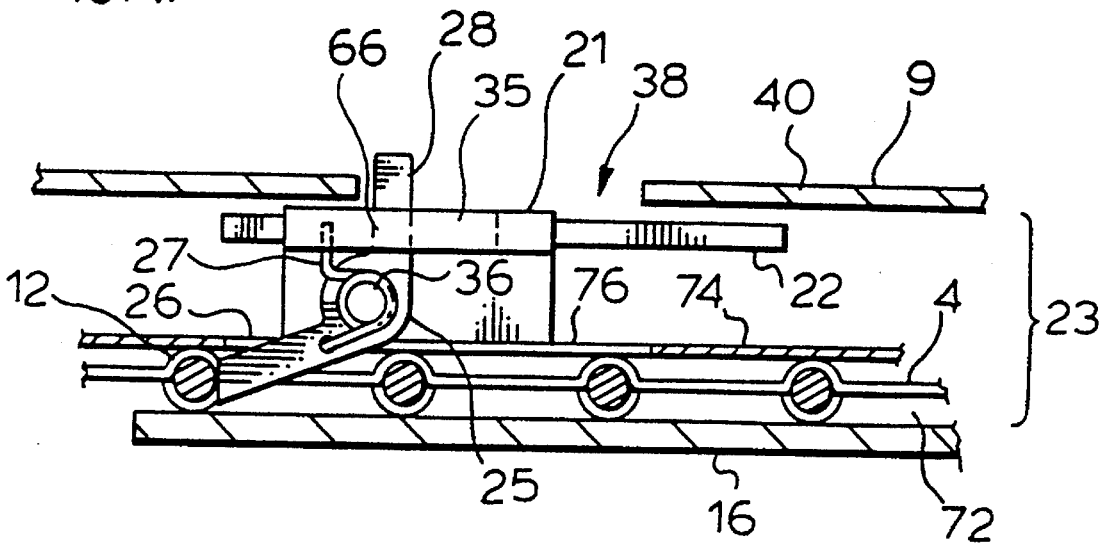
FIG. 4 is a sectional plan view along line IV—IV' of FIG. 2.
Figure 5:
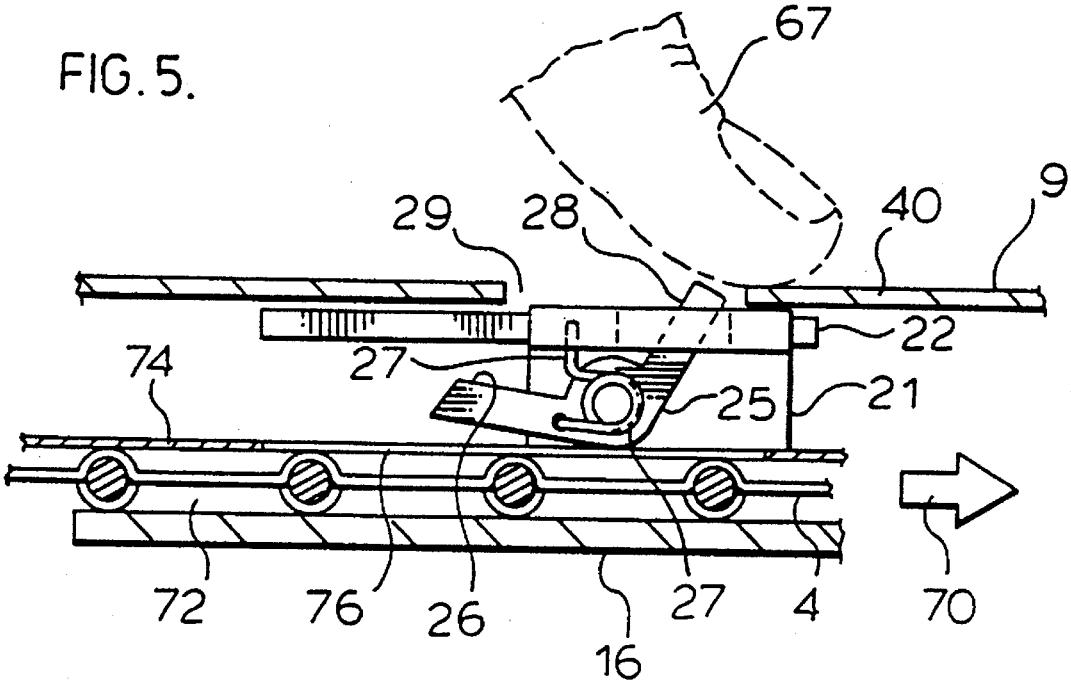
FIG. 5 shows a sectional plan view the same as in FIG. 4 but wherein the advancing pawl is manually retracted in order to release the screw strip for removal.

The shuttle 21 carries a pawl 25 to engage the screw strip and with movement of the shuttle 21 to successively advance the screw strip one screw at a time. As seen in FIG. 4, the shuttle 21 has a fixed post 36 on which the pawl 25 is journalled as illustrated about an axis parallel an axis about which the shaft 7 rotates. The pawl 25 has a strip pusher arm 26 at its forward end to engage and advance the strip. The pawl 25 has a manual release arm 28 at its rearward end which extends rearwardly through a slot 35 in the shuttle 21 and then rearwardly through a release opening 38 in a rearward wall 40 of the slide body 9 as best seen in FIGS. 4 and 5. A torsional spring 27 is disposed about post 36 between pawl 25 and shuttle 21 and urges the pusher arm 26 counterclockwise as seen in FIGS. 4 and 5. The spring 27 thus biases the pusher arm 26 into the screw strip 4. The engagement of release arm 28 on a left hand end 66 of slot 35 limits the pivoting of the pawl 25 counterclockwise to the position shown in FIG. 4.

The operation of the shuttle 21 and pawl 25 in normal operation to advance the screw strip are illustrated in FIGS. 6 to 9, representing successive steps in a cycle of reciprocating the shuttle 21 back and forth along beam 22.

Figure 6:
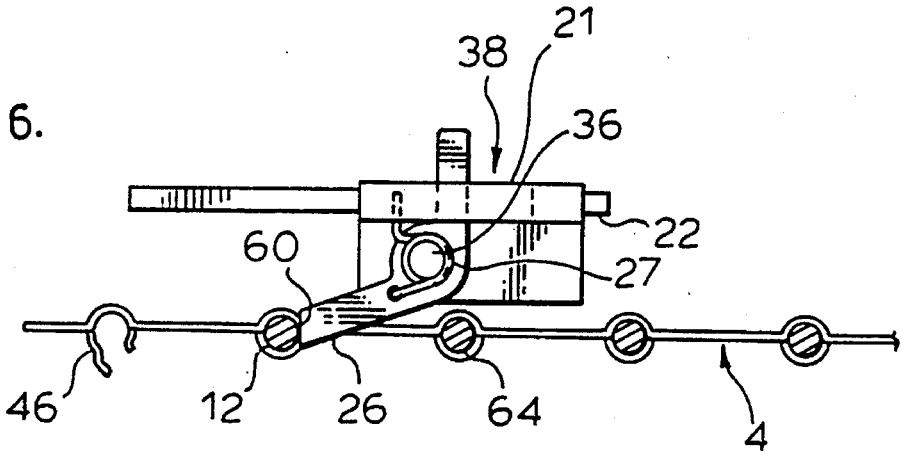
Figure 7:
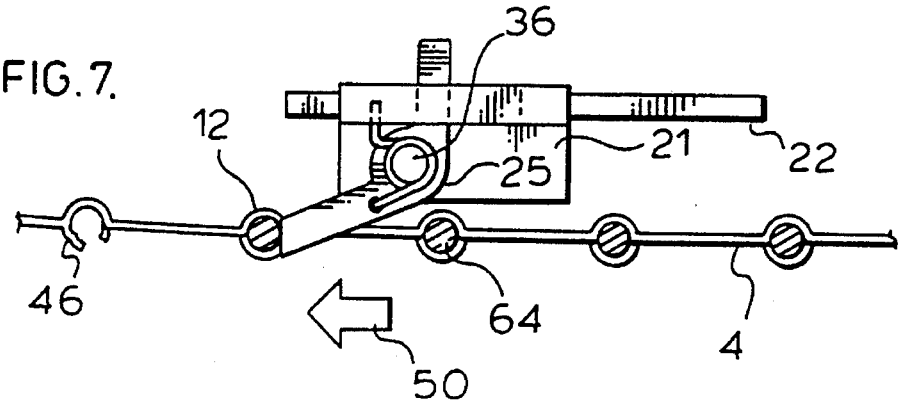
Figure 8:
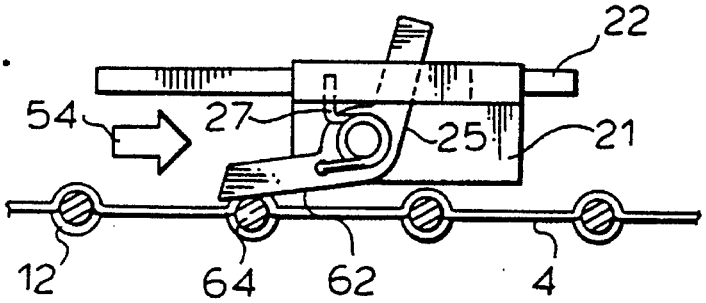
Figure 9:
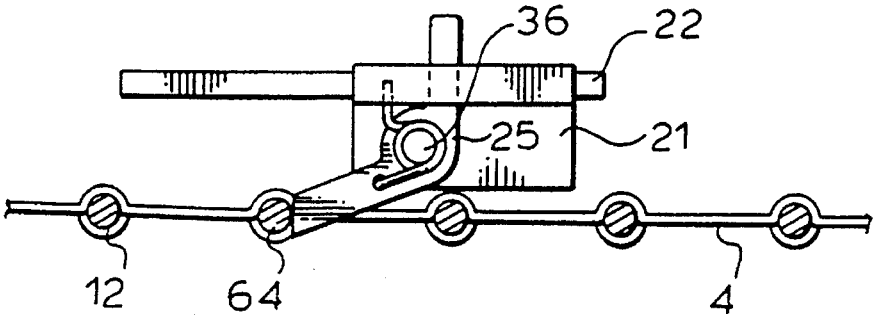

FIG. 6 shows the strip 4 as positioned with sleeve 46 in the plastic strip representing a sleeve from which a screw has been driven. As seen in FIG. 6, with an engagement face 60 of the pusher arm 26 engaged behind a screw 12, on movement of the shuttle from the right to the position in FIG. 7 the strip is advanced to the left as indicated by arrow 50 in FIG. 7 so as to position screw 12 in a position to be driven. Subsequently, the shuttle is moved to the right from the advanced position in FIG. 7 through the intermediate position in FIG. 8 to assume the retracted portion in FIG. 9 which is substantially the same as FIG. 6. FIG. 8 illustrates the shuttle 21 moving to the right as indicated by arrow 54 and with a cam face 62 of the pusher arm engaging a screw 64 and permitting pivoting of the pawl 25 against the bias of the spring 27 such that the pawl 25 may pass to the right past the screw 64. On the pusher arm 26 moving to the right past the next screw, the spring 27 urges the pawl to rotate about post 36 so that the cam face 62 is positioned ready to engage the next screw and advance it to the left. With the pawl 25 in the position shown in FIGS. 4, 6, 7 and 8, the pawl 25 prevents rearward movement and withdrawal of the screw strip 4 to the right. To permit manual withdrawal of the screw strip 4, as shown in FIG. 5, the manual release arm 28 may be pivoted, as by a user's finger 67, clockwise against the bias of spring 27 so that the pusher arm 26 is moved away from and clear of the screw strip 4. With the release arm 28 held in the position shown in FIG. 5, the screw strip 4 may be manually withdrawn in the direction of arrow 70, as may be useful, for example, to clear jams or change screw strips. As illustrated, the lateral slot 23 is parallel to another second slot 72 defined between wall 74 and cover plate 16 to have a uniform transverse cross section which is configured to slidingly receive the strip 4. An opening 76 in wall 74 permits the pusher arm 26 to extend from the first slot 23 into second slot 72 to engage the screw strip. Slot 23 provides a housing for the shuttle 21 and guide beam 22 to incrementally advance the fasteners of the strip within the lateral slot 72 and to align the lead fastener 12 coaxially with the shaft 7.

As in prior art devices, the lateral slot 23 is illustrated as defined under the cover plate 16 which may be removed for clear access to the mechanism by removing thumb screw 24. However it will be apparent that in accordance with the present invention, it is not necessary to have a removable cover plate and the invention specifically includes a device as illustrated but in which the cover plate 16 is not removable. To withdraw the screw strip 4 it is not necessary to remove any cover plate 16 but merely to actuate a pawl release mechanism in the manner illustrated in FIG. 5. In the illustrated embodiments, the shuttle 21 and pawl 25 are both provided rearward of a plane through the lateral slot 72 in which the screws of the strips lie. Alternately, the shuttle 21 and pawl 25 could in an embodiment without a cover on the front, be provided forward of this plane and with the release arm to extend out the front.

As shown in FIG. 8, the spring 27 enables the pusher arm 26 to be drawn rearwardly over the strip 4 in order to engage a successive screw 64 while maintaining the bias of the pusher arm 26 into engagement with the strip 4. As shown in FIG. 5, in order to manually disengage the pawl 25 from the strip 4 and permit the screw strip 4 to be removed from the lateral slot 23, the pawl 25 includes the manual release arm 28 at a rearward end of the rocker pawl 25 which extends through the release opening in the rearward wall of the slide body 9.

The shuttle 25 is slidably mounted in the body 9 to reciprocate parallel to the longitudinal axis of the lateral slot 23 on the guide beam 22. In the preferred embodiment illustrated the pawl 25 comprises a rocker which is medially pivoted on the shuttle 21. Other forms of biased pawls may be provided. The elongate guide beam 22 is connected to the slide body 9 and has a beam axis disposed parallel to the longitudinal axis of the lateral slot 23. The shuttle 21 is slidably engaged on the guide beam 22. Preferably the guide beam and shuttle have mating interlocking cross-sections as with the beam having a T-shaped transverse cross section and the shuttle 21 having a mating T-shaped groove as shown in FIG. 3. Many other arrangements of shuttles moving parallel the direction of advance of the screw strip may be provided. The indexing arm 17 has its slotted end connect with the pin 32 which actuates the shuttle 21 to slide on the guide beam 22 in response to rotational movement of the indexing arm 17.

FIG. 2 illustrates a position in which in use the operator has exerted downward pressure on the screwdriver 1 and the slide body 9 has telescoped into the housing 11 to an extent that the shaft 7 is engaged with the head of the lead fastener 12 in an engaged position. It will be apparent that the shaft 7 is journalled and longitudinally slidably housed in a bore to be movable with housing 11 between such an engaged position and a withdrawn position to enable the screws to be advanced forwardly.

It is to be appreciated that in known manner of the operation of a power screwdriver as taught by U.S. Pat. No. 4,146,871 to Mueller, the reciprocal movement of slide body 9 in housing 11, and the reciprocal pivoting of indexing arm 717 reciprocally moving shuttle 21 must all be coordinated and sequenced so as to provide for proper operation of the screwdriver to drive successive screws. The present invention illustrates a preferred mechanism for a pawl which not only advances a screw strip but also permits manually activated release of the screw strip for manual withdrawal. In the context of the pawl 25 illustrated, the manner in which the relative cyclical reciprocal sliding movement of the slide body 9 and housing 11 is translated to cyclical reciprocal movement of the pawl 25 may take the form many different mechanical linkages.

It will be understood that, although various features of the invention have been described with respect to one or another of the embodiments of the invention, the various features and embodiments of the invention may be combined or used in conjunction with other features and embodiments of the invention as described and illustrated herein.

The embodiments of the invention in which an exclusive property or privilege is claimed are defined as follows:

1. An apparatus for sequentially driving fasteners from a fastener strip comprising a plurality of fasteners secured in a row in a holding strip, the apparatus comprising:

a slide body having a lateral slot and an intersecting vertical bore, the lateral slot having a slot axis and a uniform transverse cross-section configured to slidingly receive said fastener strip;

an elongate driver shaft having a shaft axis of rotation, said shaft including fastener driving bit means for engaging and driving a lead fastener in succession into said work piece, said shaft being journalled and longitudinally slidably housed in said bore between an engaged position and a withdrawn position;

advance means mounted to said body for incrementally forwardly advancing the fasteners of said fastener strip within the lateral slot in succession and for aligning the lead fastener coaxially with said bore, said advance means comprising:

an elongate guide connected to said slide body having a guide axis disposed parallel to the slot axis;

a shuttle slidably engaged with said guide for reciprocal sliding along the guide parallel the longitudinal axis of the lateral slot between an advanced position and a retracted position;

the guide and shuttle have mating cross sections normal the guide axis;

a pawl pivotably supported on said shuttle, the pawl having a strip pusher arm at a forward end thereof;

a pawl biasing means engaging the pawl and shuttle for urging the pusher arm into engagement with the fastener strip; and pawl release means engaging the pawl for manually disengaging the pawl from the fastener strip, thereby permitting the fastener strip to be removed from the lateral slot.

2. An apparatus as claimed in claim 1 wherein said pawl pivots about a pivot axis substantially parallel the shaft axis, and the slot axis is substantially normal the shaft axis.

3. An apparatus as claimed in claim 2 wherein the fasteners in the fastener strip lie in a plane extending through the lateral slot, and the shuttle and pawl are both disposed on one side of the plane.

4. An apparatus as claimed in claim 1 wherein said pusher arm has an end to engage the fastener strip to advance it and prevent rearward removal thereof and a side to engage the fastener strip on rearward movement of the shuttle from the advanced position to the retracted position and cam the pawl to pivot against the bias of the pawl biasing means permitting movement of the fastener strip forwardly relative the pawl.

5. An apparatus according to claim 1 wherein the slide body includes a manual release opening in a wall thereof, and the pawl comprises a rocker medially pivoted on the shuttle, the pawl having a manual release arm at a rearward end extending through said release opening.

6. An apparatus as claimed in claim 5 wherein the release arm extending from the pawl away from the fastener strip and out of the slide body to present a portion of the release arm accessible for manual engagement.

7. An apparatus according to claim 1 wherein the guide comprises a guide beam and the guide beam and shuttle have mating interlocking cross sections.

8. An apparatus according to claim 1 further comprising:

a housing slidably coupled to the slide body for displacement parallel to the shaft axis, and rotatably supporting said shaft, the housing including a cam surface, and having a portion overlapping said slide body; and wherein the shuttle includes cam follower means coacting with said cam surface for sliding said shuttle along the guide in response to relative displacement between the housing and slide body.

9. An apparatus as claimed in claim 1 wherein the pawl comprises a rocker medially pivoted on the shuttle with the pawl release means comprising a manual release arm at a rearward end thereof.

10. An apparatus as claimed in claim 9 wherein the pawl is pivotable between a first position in which the pawl is positioned to engage the fastener strip to forwardly advance the fastener strip within the lateral slot on movement of the shuttle from the retracted position to the advanced position and to prevent rearward removal of the fastener strip from the lateral slot and a second position in which the pawl is disengaged from the fastener strip and the fastener strip may be removed rearwardly from the lateral slot; and the manual release arm manually activatable to move the pawl from the first position to the second position.

11. An apparatus as claimed in claim 10 wherein said pawl biasing means biasing the pawl from the first position towards the second position.

12. An apparatus as claimed in claim 10 wherein said pawl biasing means comprises spring means disposed between said shuttle and the pawl and biasing said pawl to pivot towards the first position, the apparatus including pawl stop means to stop movement of the pawl under the bias of the spring means at the second position.

13. An apparatus as claimed in claim 12 wherein said stop means is carried on said shuttle.

14. An apparatus as claimed in claim 10 wherein said pawl includes a cam surface to engage the fastener strip on rearward movement of the shuttle from the advanced position to the retracted position and cam the pawl to pivot against the bias of the biasing means permitting movement of the fastener strip forwardly relative the pawl.

15. An apparatus as claimed in claim 10 wherein said pawl pivots about a pivot axis substantially parallel the shaft axis, and the slot axis is substantially normal the shaft axis.

16. An apparatus as claimed in claim 1 wherein the guide comprises a guide beam.

* * * * *

UNITED STATES PATENT AND TRADEMARK OFFICE

CERTIFICATE OF CORRECTION

PATENT NO. : 5,570,618

DATED : November 5, 1996

INVENTOR(S) : G. Lyle Habermehl and Paul T. Scherer

It is certified that error appears in the above-indentified patent and that said Letters Patent is hereby corrected as shown below:

Column 7, line 14 reads "717" but should read "17"

Signed and Sealed this

Twentieth Day of May, 1997

*Attest:*

*Attesting Officer*

Bruce Lehman

BRUCE LEHMAN

*Commissioner of Patents and Trademarks*